US012312110B2

(12) United States Patent
Rossi

(10) Patent No.: US 12,312,110 B2
(45) Date of Patent: May 27, 2025

(54) MACHINE FOR PACKAGING GROUPS OF PRODUCTS IN A ROLL

(71) Applicant: T.M.C. S.P.A., Castel Guelfo (IT)

(72) Inventor: William Rossi, San Giorgio di Piano (IT)

(73) Assignee: T.M.C. S.P.A., Castel Guelfo (IT)

( * ) Notice: Subject to any disclaimer, the term of this patent is extended or adjusted under 35 U.S.C. 154(b) by 0 days.

(21) Appl. No.: 18/550,058

(22) PCT Filed: Mar. 16, 2022

(86) PCT No.: PCT/IB2022/052367
§ 371 (c)(1),
(2) Date: Sep. 11, 2023

(87) PCT Pub. No.: WO2022/200924
PCT Pub. Date: Sep. 29, 2022

(65) Prior Publication Data

US 2024/0182193 A1 Jun. 6, 2024

(30) Foreign Application Priority Data

Mar. 24, 2021 (IT) ..... 102021000007187

(51) Int. Cl.
*B65B 1/00* (2006.01)
*B65B 11/22* (2006.01)
*B65B 25/14* (2006.01)

(52) U.S. Cl.
CPC ..... *B65B 11/22* (2013.01); *B65B 25/146* (2013.01)

(58) Field of Classification Search
CPC ..... B65B 11/22; B65B 25/146; B65B 35/44; B65B 59/001; B65B 11/12; B65B 11/20
USPC ..... 53/203, 466, 228, 209, 447, 230
See application file for complete search history.

(56) References Cited

U.S. PATENT DOCUMENTS 6,067,780 A * 5/2000 Gentili ..... B65B 25/146 53/376.2
2005/0229538 A1* 10/2005 Dall' Omo ..... B65B 11/22 53/134.1
2005/0229546 A1* 10/2005 Poli ..... B65B 51/14 53/228

FOREIGN PATENT DOCUMENTS

IT F120120220 4/2014

OTHER PUBLICATIONS

International Search Report dated May 24, 2022 from counterpart PCT App No. PCT/IB2022/052367.

* cited by examiner

*Primary Examiner* — Jacob A Smith
(74) *Attorney, Agent, or Firm* — SHUTTLEWORTH & INGERSOLL, PLC; Timothy J. Klima

(57) ABSTRACT

A machine for packaging groups of products in a roll with a sheet of film includes a first station wrapping the sheet on four consecutive sides of the group of products. For each of the two heads of the group, upper and lower horizontal flaps and first and second vertical flaps protrude. A second station for folding the four flaps has a conveyor surface for moving the group along a feed direction. A Folding devices, positioned on opposite sides of the conveyor fold the corresponding pairs of the flaps towards the head of the group. A device for generating a negative fluid pressure for each side of the conveyor surface, located before the device for folding each lower horizontal flap, relative to the feed direction, is configured to obtain, by generating a localised vacuum, a raising of the lower horizontal flap with respect to the conveyor surface.

16 Claims, 5 Drawing Sheets

MACHINE FOR PACKAGING GROUPS OF PRODUCTS IN A ROLL

This application is the National Phase of International Application PCT/IB2022/052367 filed Mar. 16, 2022 which designated the U.S.

This application claims priority to Italian Patent Application No. 102021000007187 filed Mar. 24, 2021, which applications are incorporated by reference herein.

TECHNICAL FIELD

This invention relates to a machine for packaging groups of products in a roll.

BACKGROUND ART

The current machines for forming and packaging groups of products in rolls for hygiene/medical use (known in the jargon of the trade as "tissue") substantially have two main packaging stations interconnected with each other:

- the first wrapping station comprises a vertical lift device for the group of products formed configured to move the group of products into contact with a sheet of wrapping film and to define the wrapping of the film on the group of products around the four consecutive surfaces of longest extension of the group of products and the lower closing of the free flaps of the film;
- the second station for wrapping the heads and their closing of the package (of particular interest in this specification) comprises a tunnel formed by suitable walls in which the group of products is fed (in a direction transversal to the lifting direction of the group) and in which the bilateral walls are equipped with mechanical devices for folding and sealing the flaps which are gradually folded according to a predetermined succession until they are completed.

In this second wrapping station, as mentioned, the group of products initially has the four projecting lateral flaps of the sheet of film on the two head surfaces of the group.

These flaps, regardless of the order of folds to be performed, are gradually folded (towards the corresponding head T of the group G of products) about horizontal axes, the two upper and lower horizontal flaps L1 and L2 of greatest extension, and about vertical axes, the two vertical flaps L3 and L4 of smallest extension, using folding devices and folding spirals which are mainly "mechanical". (see for example FIG. 1).

In a first prior art folding solution, during the feeding of the group of products in the tunnel there is the subsequent folding sequence (described for a head of the group, but similar also for the opposite head):

- folding the upper horizontal flap using, for example, a jet of air directed from the top downwards, or again using mechanical folding devices;
- folding the first lateral vertical flap using mechanical devices (with partial superposing on the upper horizontal flap);
- folding the second lateral vertical flap using mechanical devices or by opposing the movement of the group of products against a static folding device in a specific position; in this case, the feeding of the group against the folding device triggers the forced folding of the lateral vertical flap (with partial superposing on the upper horizontal flap);
- the last fold is that of the lower horizontal flap obtained using mechanical folding devices in a fixed position which act in conjunction with the moving group to allow the lower flap to be lifted and superposed on the three previous flaps folded.

After the last fold, the tunnel is equipped with devices for sealing the folded flaps so as to obtain the closed package.

A second prior art sequence which differs from the previous sequence (determined by the different structure of the tunnel) comprises folding in sequence: the first vertical flap, the second vertical flap, the second lower horizontal flap and, lastly, the first upper horizontal flap.

This type of system also uses the mechanical folding systems or air jet systems described above, but positioned in a different manner along the bilateral walls forming the tunnel for passage of the group of products.

One of the major needs of the manufacturers of these machines is the always felt final quality of the package of the groups of products, irrespective of the type of tunnel and the sequence of folding of the flaps used.

A high quality element sought in packages of groups of products of this kind is the shape of the lower or upper horizontal flap to be folded (in particular the lower one) as regular as possible with rectilinear folding angles and directions.

In fact, the defects linked to the operations for folding the horizontal flaps (due to the physical characteristics of the packaging materials used, of the electrostatic charges which they accumulate by rubbing on surfaces and the relative friction) can determine a poor final appearance of the wrapping due to the generation of "false-folds".

This defect is generated by the fact that, for example, the lower horizontal flap starts to be lifted by interference on a fixed folder.

This step generates a phenomenon which manifests itself immediately as a "false-fold" triggered by the impact of the lower flap which moves at a speed linked to the system for conveying the groups of products and the folding system which, on the contrary, is fixed and therefore at zero speed.

During this impact it is possible, as mentioned above, to trigger "false folds" and the spiral-shaped trend of the folding device may interfere with the final shape of the raised horizontal flap which could generate fold directions which are not straight, thus changing the profile from perfectly right-angled trapezium. As a result of this effect, the package may be of low final quality.

DISCLOSURE OF THE INVENTION

The aim of the invention is to provide a machine for packaging groups of products in a roll that overcomes the above mentioned drawbacks of the prior art.

More specifically, the aim of the invention is to provide a machine for packaging groups of products in a roll which is able to increase the end quality of the package without altering the structure of the machine and keeping constant the production speeds.

A further aim of the invention is to provide a machine for packaging groups of products in a roll which is able to help the steps for folding the flaps in synergy with the existing folders.

Said aims are fully achieved by a machine for packaging groups of products in a roll according to the invention as characterised in the appended claims.

BRIEF DESCRIPTION OF DRAWINGS

The main features of the invention will become more apparent from the following detailed description of a preferred, non-limiting embodiment, illustrated purely by way of example in the accompanying drawings, in which.

DETAILED DESCRIPTION OF PREFERRED EMBODIMENTS OF THE INVENTION

Figure 1:
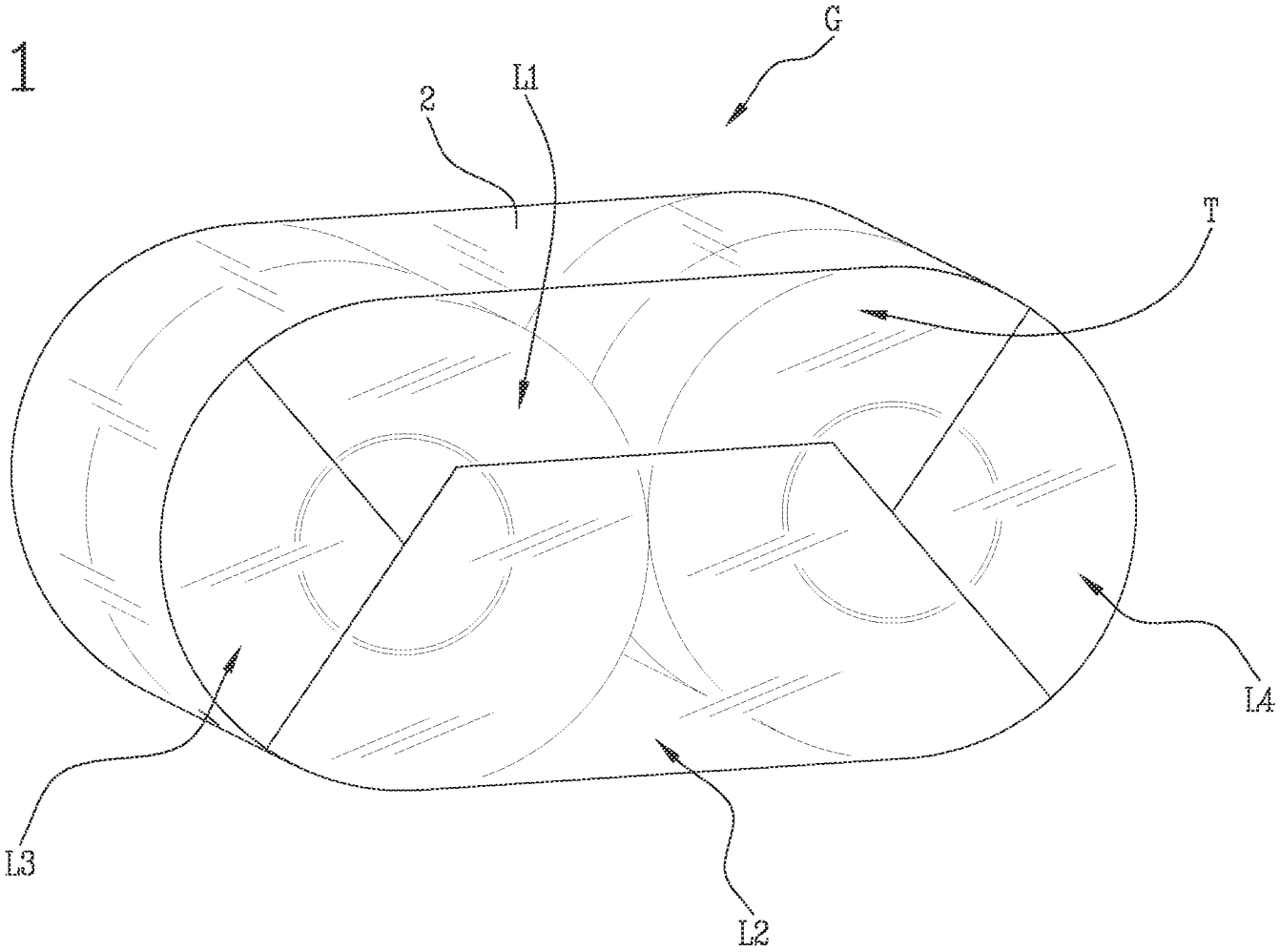
FIG. 1 is a perspective view of a package of a group of products in a roll obtained with the machine for packaging groups of products according to the invention.
Figure 2:
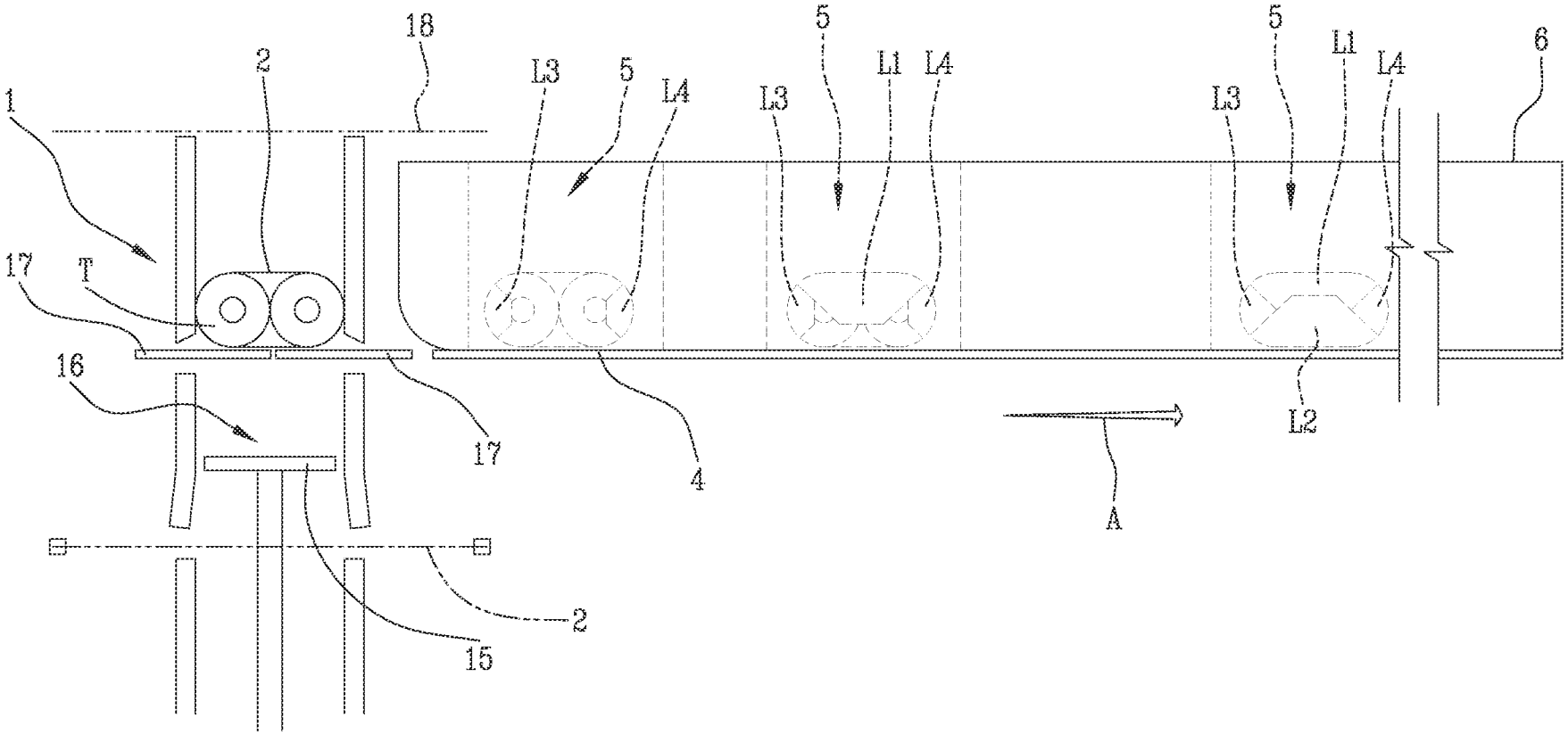
FIG. 2 is a schematic front view, with some parts cut away in order to better illustrate others, of a machine for packaging groups of products in a roll with a film, according to the invention.

With reference to the accompanying drawings, and with particular reference to FIGS. 1 and 2, the machine according to the invention is used for packaging groups of products in a roll with a sheet of film.

The term "roll of products" (see FIG. 1) means the products in a roll of the type known as tissue (rolls of toilet paper, rolls for kitchen paper and the like).

The sheet 2 of film for wrapping these products may be chosen from among Polyethylene, Polypropylene, Biopolymers, mix of those materials just mentioned, virgin paper, recycled paper, treated with polymers and/or glues.

The machine for packaging groups G of products in a roll comprises a first station 1 for wrapping with the sheet 2 of film wrapped on four consecutive sides of the group G of products in a roll and wherein, for each of the two heads T of the group G of products in a roll, an upper horizontal flap L1, a lower horizontal flap L2, a first vertical flap L3 and a second vertical flap L4 protrude (see FIG. 1).

By way of example, the first wrapping station 1 comprises a platform 15 on which the group G of products in a roll is positioned.

The platform 15 then lifts (with a vertical direction) along a channel 16 and in such a way as to allow the sheet 2 of film to be intercepted by the group G of products in a roll so as to obtain the wrapping on three consecutive sides.

The group G of products and the sheet 2 wrapped around them are then taken up (at the end of stroke of the platform 15) by a device 18 for pulling and transversal movement of the group G of products.

At the end of stroke of the group G of products there are two folding elements 17 are activated which are configured to close the fourth lower side of the group G of products.

The machine comprises a second station 3 for folding the four flaps L1-L4 on the two heads T of the group G of products in a roll.

This second station 3 comprises a conveyor surface 4 configured for moving the group G of products in a roll partly wound along a feed direction A (transversal to the vertical direction of the elevation platform 15.

The second station 3 also comprises a series of folding devices 5 (not all described and illustrated in this specification), positioned (in a fixed position) on opposite sides of the conveyor surface 4, designed to fold the corresponding pairs of head flaps, horizontal L1-L2 and vertical L3-L4, towards the corresponding head T of the group G of products in a roll during the transit of the group G of products in a roll.

The series of folding devices 5 are therefore spaced from each other along the path followed by the group G of products on the conveyor surface 4 in such a way as to allow a predetermined folding sequence of the four flaps L1-L4 for each head T through the intercepting of the respective flaps L1-L4.

The arrangement of the folding devices 5 along the conveyor surface 4 may vary as a function of the sequence of folding of the four flaps of the film.

For example, the first devices for folding the vertical flaps L3 and L4 can be positioned at the start of the path followed by the group G of products in a roll, whilst the device for folding the upper horizontal flap L1 and then of the device 5 for folding the lower horizontal flap may be positioned along the path followed by the group G of products downstream of the first two devices for folding the vertical flaps with reference to the feed direction A of the group G of products in a roll on the conveyor surface 4.

In an alternative configuration, the two devices for folding the two horizontal flaps may be positioned before (upstream) of the devices for folding the vertical flaps again with reference to the feed direction A of group G of products in a roll.

The arrangement of the folding devices does not limit the scope of protection of the invention, since the solution described for the machine according to the invention can be used in both the configurations described above.

The machine also comprises a unit 6 for sealing the four folded flaps L1-L4 for each head T positioned downstream of the series of folding devices 5, relative to the feed direction A of the group G of products in a roll.

Figure 4:
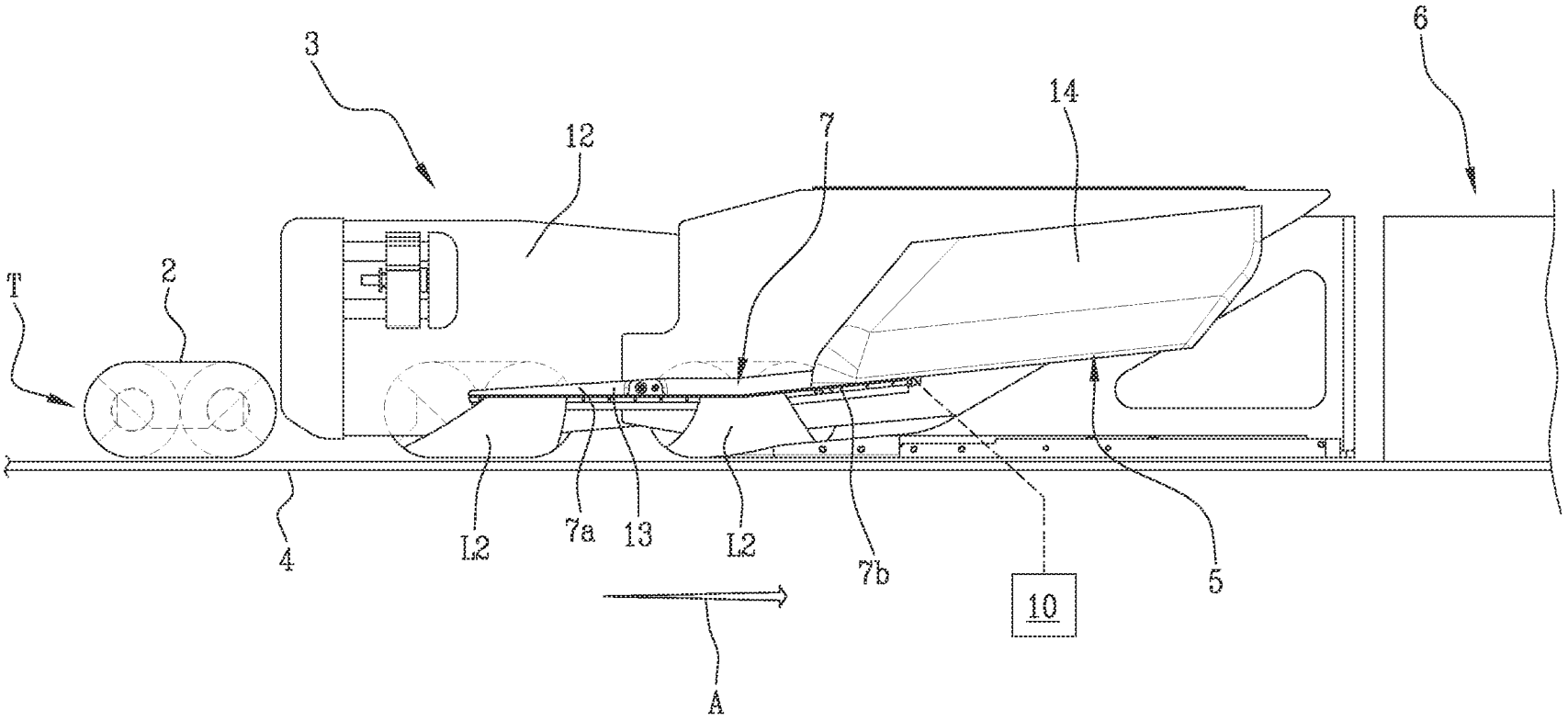
FIG. 4 is a schematic side view, with some parts cut away in order to better illustrate others, of the part of the machine of FIG. 3.

The sealing unit 6 is schematically illustrated in FIGS. 2 and 4 as a block.

Figure 3:
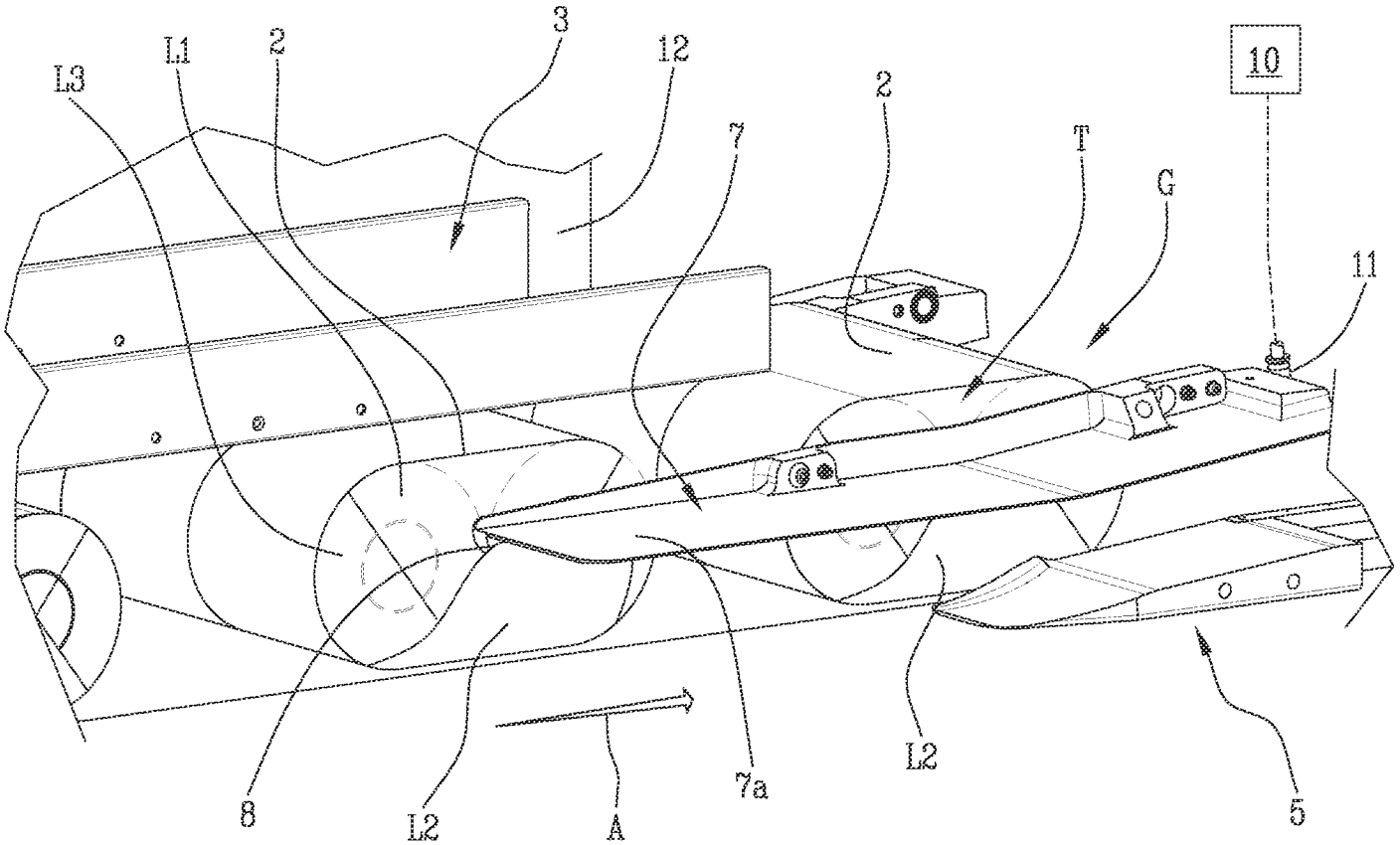
FIG. 3 is a schematic perspective view, with some parts cut away in order to better illustrate others, of a part of the machine of FIG. 2, and more specifically a zone of a second folding station equipped with a device for folding a lower horizontal flap of the film.
Figure 5:
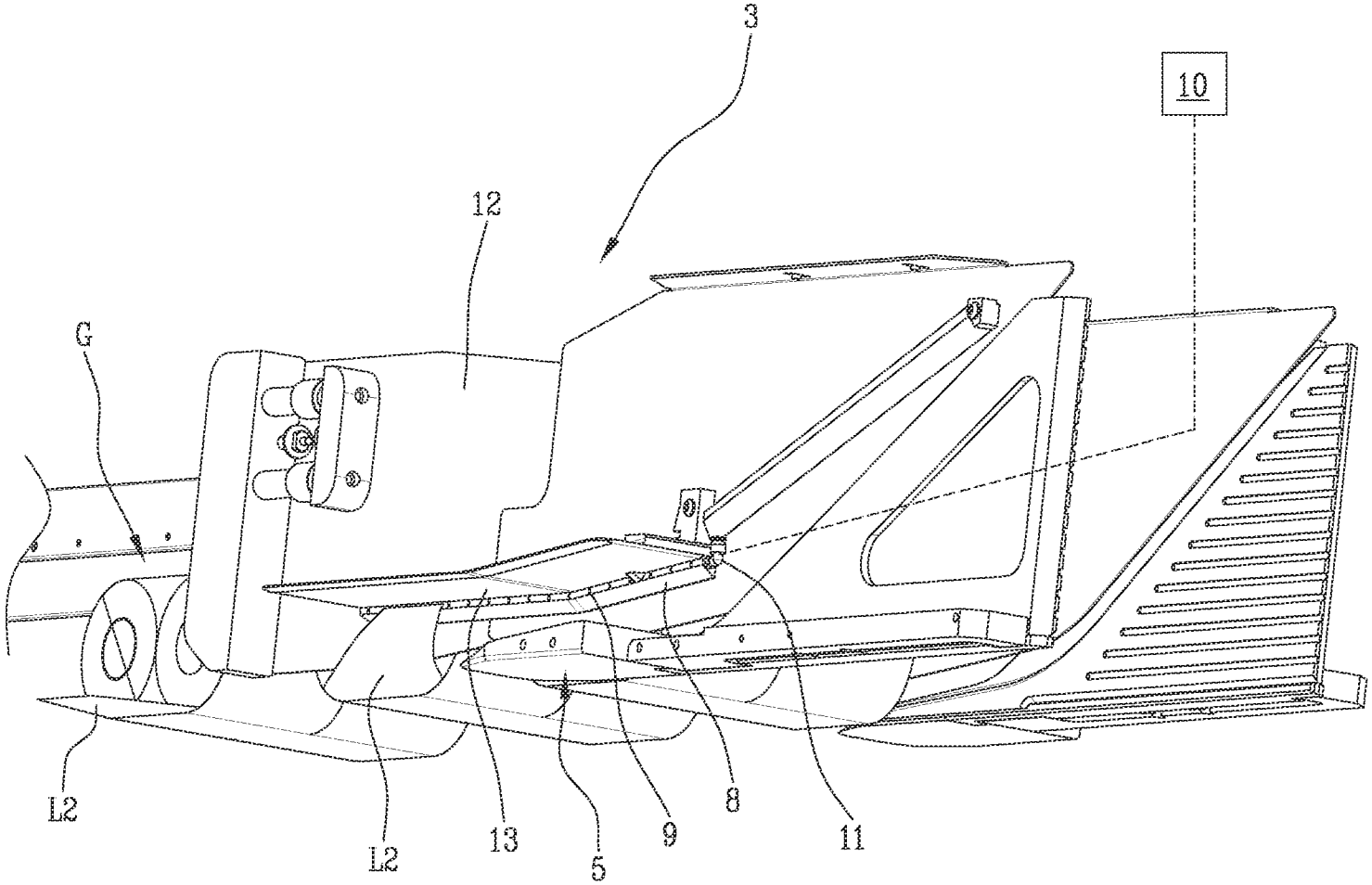
FIG. 5 is a perspective view, with some parts cut away in order to better illustrate others, of an enlarged detail of FIG. 4.

As illustrated (see FIGS. 3 to 5), the machine comprises a device 7 for generating a negative fluid pressure for each side of the conveyor surface 4.

The device 7 for generating a negative fluid pressure is positioned at least before the corresponding folding device 5 of each lower horizontal flap L2 of the sheet 2 of film, relative to the feed direction A, and configured to obtain, by generating a localised vacuum, a raising, at least partly, of the lower horizontal flap L2 with respect to the conveyor surface 4 in such a way as to define a pre-folding of the lower horizontal flap L2.

In short, the presence of a device for generating fluid allows the folding of the lower horizontal flap to be assisted with a step of active and not only passive pre-folding generated by the folding device, but based on a principle of a further mechanical spiral which is designed to at least partly lift the lower horizontal flap.

Preferably, each device 7 for generating a negative fluid pressure extends at least parallel to the conveyor surface 4 and for a stretch of the same conveyor surface 4.

In a preferred, non-limiting configuration, each device 7 for generating a negative fluid pressure comprises a first stretch 7*a* extending parallel to the conveyor surface 4 and a second stretch 7*b*, after the first stretch 7*a* relative to the feed direction A, partly superposed on the device 5 for folding the lower horizontal flap L2.

In light of this, the second stretch 7*b* of the device 7 for generating a negative fluid pressure extends at an angle to the first stretch 7*a*, and substantially parallel to the extension of the device 5 for folding the lower horizontal flap L2 along the feed direction A, in such a way as to interact at least partly with the same folding device 5 of the lower horizontal flap L2.

In a non-limiting embodiment, each device 7 for generating a negative fluid pressure comprises a bar 8 extending at least parallel to the conveyor surface 4 and at a height higher than the same conveyor surface 4.

The bar 8 is configured to define a fluid passage duct equipped with a plurality of holes 9 open along its extension and oriented according to a direction opposite to the zone of passage of the group G of products in a roll on the conveyor surface 4.

A source 10 of fluid (air) is connected to a nozzle 11 of the duct having an internal cross-section configured to create a negative pressure along the entire extension of the duct and therefore through the open holes 9 present, in such a way as to allow the lifting (and a partial retaining), at least partly, of the lower horizontal flap L2.

In other words, the bar 8 can, as a structure, act on the principle of vacuum pumps with a Venturimeter.

In this way, the ambient air is sucked by the holes 9 along the stretch of bar 8 and also draws towards the bar the horizontal flap L2 which from a position coplanar with the conveyor surface 4 starts to rise and therefore move towards the bar 8 (and therefore to the head T of the group G of products in a roll).

Preferably, the bar 8 comprises an inclined stretch having open holes 9 for generating a negative pressure also above a portion of the device 5 for folding the lower horizontal flap L2.

In this way, the start of the folding of the flap performed by the folding device 5 is again assisted by the bar 8 for at least a first stretch of the extension of the folding device 5.

Preferably, each device 7 for generating a negative fluid pressure is at least partly associated with a corresponding wall 12 transversal to the conveyor surface 4.

The pair of walls 12 is positioned on opposite sides to at least one stretch of the conveyor surface 4 in such a way as to retain on both sides the group G of products in a roll in transit.

Preferably, the device 5 for folding the lower horizontal flap L2 is a fixed plate with a spiral-shaped profile configured for intercepting and lifting completely the lower horizontal flap L2, at the transit of the group G of products in a roll along the conveyor surface 4, and partly raised by the device 7 for generating a negative fluid pressure.

Preferably each device 7 for generating a negative fluid pressure comprises the bar 8 having a tab 13 protruding in a direction parallel to the conveyor surface 4 for intercepting and retaining a part of the lower horizontal flap L2 during its partial lifting.

The purpose of this tab 13 is to not disperse upwards the negative pressure flow generated by the holes and also to limit the lifting of the lower horizontal flap L2.

It should be noted that a guard 14 for covering the end of the bar 8 and the fixed spiral-shaped plate is associated on the end of each bar 8 superposed on the folding device 5 of the lower horizontal flap L2, along the feed direction A, configured to protect the lower horizontal flap L2 until it is completely raised.

Basically, therefore, the guard 14 allows the surface of the folding spiral to be isolated until the end of lifting and until contact of the flap with the head T of the group G of products in a roll.

The machine structured in this way thus achieves the preset aims thanks to a negative pressure device which is able to define a first partial folding of the lower horizontal flap.

Thanks to this device it is possible to avoid the generation of false-folds in the folding of the lower horizontal flap, making the contact with the fixed folding device softer and consequently reducing the mutual friction between flap and spiral.

The presence of a first fold on the flap using the negative pressure generated by the device helps to overcome the generation of false folds, thus reducing the effect of impact of the flap with the fixed folder because it lifts it and then reduces the rubbing friction between the fixed folder and the film.

Moreover, the device for generating negative pressure is structurally simple and linear, can be applied and removed without the structure of the machine being modified and can therefore adapted both in terms of extension and height in a fast and simple manner and according to production requirements.

The invention claimed is:

1. A machine for packaging groups of products in a roll with a sheet of film; the machine comprising at least:

a first station for wrapping with the sheet of film wrapped on four consecutive sides of the group of products in the roll and wherein, for each of two heads of the group of products in the roll, an upper horizontal flap, a lower horizontal flap, a first vertical flap and a second vertical flap protrude;

a second station for folding the four flaps onto the two heads of the group of products in the roll, having:

a conveyor surface configured for moving the group of products in the roll partly wound along a feed direction;

a series of folding devices, positioned on opposite sides of the conveyor surface and configured to fold the corresponding pairs of head flaps, horizontal and vertical, towards the corresponding head of the group of products in the roll during passage of the group of products in the roll; the series of folding devices being spaced from each other along the path followed by the group of products on the conveyor surface to allow a predetermined folding sequence of the four flaps for each head;

a unit for sealing the four folded flaps for each head located downstream of the series of folding devices; relative to the feed direction of the group of products in the roll, a device for generating a negative fluid pressure for each side of the conveyor surface, positioned at least before the corresponding device for folding each lower horizontal edge of the sheet of film, relative to the feed direction, and configured to obtain, by generating a localised vacuum, a raising, at least partial, of the lower horizontal flap with respect to the conveyor surface to define a pre-folding of the lower horizontal flap;

wherein each device for generating the negative fluid pressure comprises a first stretch extending parallel to the conveyor surface and a second stretch, after the first stretch relative to the feed direction, partly superposed on the device for folding the lower horizontal flap.

2. The machine according to claim 1, wherein each device for generating the negative fluid pressure extends at least parallel to the conveyor surface and for a stretch of the conveyor surface.

3. The machine according to claim 1, wherein the second stretch of the device for generating the negative fluid pressure extends at an angle to the first stretch, and substantially parallel to the extension of the device for folding the lower horizontal flap along the feed direction, to interact at least partly with the folding device of the lower horizontal flap.

4. The machine according to claim 1, wherein each device for generating the negative fluid pressure comprises a bar extending at least parallel to the conveyor surface and at a height higher than the conveyor surface; the bar being configured to define a fluid passage duct including a plurality of holes open along an extension thereof and oriented according to a direction opposite to a zone of passage of the group of products in the roll on the conveyor surface; a source of fluid being connected to a nozzle of the duct having an internal cross-section configured to create a negative pressure along the entire extension of the duct and therefore through the open holes present, to allow the lifting, at least partly, of the lower horizontal flap.

5. The machine according to claim 4, wherein the bar comprises an inclined stretch having open holes for generating the negative pressure also above a portion of the device for folding the lower horizontal flap.

6. The machine according to claim 4, wherein each device for generating the negative fluid pressure comprises the bar having a tab protruding in a direction parallel to the conveyor surface for intercepting and retaining a part of the lower horizontal flap during the at least partial lifting.

7. The machine according to claim 4, and further comprising a guard for covering an end of the bar and the fixed spiral-shaped plate is positioned at the end of each bar superposed on the folding device of the lower horizontal flap, along the feed direction, and configured to protect the lower horizontal flap until the lower horizontal flap is completely raised.

8. The machine according to claim 1, wherein each device for generating the negative fluid pressure is at least partly associated with a corresponding wall transversal to the conveyor surface; with a pair of the walls being positioned on opposite sides of at least one stretch of the conveyor surface bilaterally retain the group of products in the roll in transit.

9. The machine according to claim 1, wherein the device for folding the lower horizontal flap is a fixed plate with a spiral-shaped profile configured for intercepting and lifting completely the lower horizontal flap, at the transit of the group of products in the roll along the conveyor surface, and partly raised by the device for generating the negative fluid pressure.

10. A machine for packaging groups of products in a roll with a sheet of film; the machine comprising at least:

a first station for wrapping with the sheet of film wrapped on four consecutive sides of the group of products in the roll and wherein, for each of two heads of the group of products in the roll, an upper horizontal flap, a lower horizontal flap, a first vertical flap and a second vertical flap protrude;

a second station for folding the four flaps onto the two heads of the group of products in the roll, having:

a conveyor surface configured for moving the group of products in the roll partly wound along a feed direction;

a series of folding devices, positioned on opposite sides of the conveyor surface and configured to fold the corresponding pairs of head flaps, horizontal and vertical, towards the corresponding head of the group of products in the roll during passage of the group of products in the roll; the series of folding devices being spaced from each other along the path followed by the group of products on the conveyor surface to allow a predetermined folding sequence of the four flaps for each head;

a unit for sealing the four folded flaps for each head located downstream of the series of folding devices; relative to the feed direction of the group of products in the roll, a device for generating a negative fluid pressure for each side of the conveyor surface, positioned at least before the corresponding device for folding each lower horizontal edge of the sheet of film, relative to the feed direction, and configured to obtain, by generating a localised vacuum, a raising, at least partial, of the lower horizontal flap with respect to the conveyor surface to define a pre-folding of the lower horizontal flap;

wherein each device for generating the negative fluid pressure comprises a bar extending at least parallel to the conveyor surface and at a height higher than the conveyor surface; the bar being configured to define a fluid passage duct including a plurality of holes open along an extension thereof and oriented according to a direction opposite to a zone of passage of the group of products in the roll on the conveyor surface; a source of fluid being connected to a nozzle of the duct having an internal cross-section configured to create a negative pressure along the entire extension of the duct and therefore through the open holes present, to allow the lifting, at least partly, of the lower horizontal flap;

wherein the bar comprises an inclined stretch having open holes for generating the negative pressure also above a portion of the device for folding the lower horizontal flap.

11. The machine according to claim 10, wherein each device for generating the negative fluid pressure extends at least parallel to the conveyor surface and for a stretch of the conveyor surface.

12. The machine according to claim 10, wherein the second stretch of the device for generating the negative fluid pressure extends at an angle to the first stretch, and substantially parallel to the extension of the device for folding the lower horizontal flap along the feed direction, to interact at least partly with the folding device of the lower horizontal flap.

13. The machine according to claim 10, wherein each device for generating the negative fluid pressure is at least partly associated with a corresponding wall transversal to the conveyor surface; with a pair of the walls being positioned on opposite sides of at least one stretch of the conveyor surface to bilaterally retain the group of products in the roll in transit.

14. The machine according to claim 10, wherein the device for folding the lower horizontal flap is a fixed plate with a spiral-shaped profile configured for intercepting and lifting completely the lower horizontal flap, at the transit of the group of products in the roll along the conveyor surface, and partly raised by the device for generating the negative fluid pressure.

15. The machine according to claim 10, wherein each device for generating the negative fluid pressure comprises the bar having a tab protruding in a direction parallel to the conveyor surface for intercepting and retaining a part of the lower horizontal flap during the at least partial lifting.

16. The machine according to claim 10, and further comprising a guard for covering an end of the bar and the fixed spiral-shaped plate is positioned at the end of each bar superposed on the folding device of the lower horizontal flap, along the feed direction, and configured to protect the lower horizontal flap until the lower horizontal flap is completely raised.

* * * * *